United States Patent [19]

Chartrain et al.

[11] Patent Number: 4,555,159

[45] Date of Patent: Nov. 26, 1985

[54] BATTERY POST CONNECTOR

[76] Inventors: Armand N. Chartrain, 115 Poinsettia Gardens, Ventura, Calif. 93004; Lee A. Genne, 1220 Johnson Dr., No. 111, Ventura, Calif. 93003

[21] Appl. No.: 638,276

[22] Filed: Aug. 6, 1984

[51] Int. Cl.[4] ..... H01R 11/26

[52] U.S. Cl. ..... 339/239; 339/238

[58] Field of Search ..... 339/239, 238, 235

[56] References Cited

U.S. PATENT DOCUMENTS 3,838,386 9/1974 Chartrain et al. ..... 339/239

*Primary Examiner*—Gil Weidenfeld
*Assistant Examiner*—Paula A. Austin
*Attorney, Agent, or Firm*—Kenneth J. Hovet

[57] ABSTRACT

A quick-release battery post connector having an electrically conductive U-shaped clamp with legs that are connected by a pivot member which reciprocates in response to movement of a lever about an upstanding post on each leg. The lever has a boss that rotates within an opening in the pivot member and includes an aperture into which extends one of the clamp leg posts. The aperture axis is offset from the rotational axis of the boss whereby movement of the lever will result in changing the distance between the spaced-apart legs.

14 Claims, 11 Drawing Figures

BATTERY POST CONNECTOR

BACKGROUND OF THE INVENTION

1. Field of the Invention

The present invention relates to connections to electrical storage batteries and, more particularly, to battery terminal connector means.

2. Description of the Prior Art

Basic cam-operated battery terminal connectors are shown in U.S. Pat. Nos. 1,865,681 and 2,737,636. Both of these patents disclose an eccentric cam which rotates directly against the battery post to secure the connector.

A cam shaft is used in U.S. Pat. No. 1,896,988 to loosen or tighten a split sleeve. The sleeve, in turn, surrounds a battery post to form the connection. Corrosion, wear and battery post damage are common with the above devices.

Additional indirect connecting assemblies are shown in U.S. Pat. Nos. 3,521,223; 3,529,281; and 3,838,386. In each of the patented embodiments, the end of a battery cable is equipped with a sleeve that encloses a battery post. The sleeve is encircled with a variety of different plastic clamping mechanisms.

With the multitude of parts required in the above assemblies, cost, maintenance and repair become significant detrimental factors. Because of the insulative nature of plastic and its encirclement of the sleeve and post, heat transfer is greatly inhibited. This results in unwanted thermal degradation of parts, increased amounts of destructive gases, corrosion build-up and poor electrical conductivity. Poor heat transfer also diminishes battery life and creates more battery maintenance. Considering the daily use (discharging) and recharging of storage batteries in electrical powered vehicles, anything that enhances battery life and reduces maintenance costs is highly desirable.

SUMMARY OF THE INVENTION

The present invention obviates the above-enumerated prior art disadvantages by providing a connector assembly that includes an electrically conductive clamp in direct contact with a battery post. The prior art battery cable sleeve is eliminated with all its attendant problems of corrosion and heat transfer.

Incorporated with the clamp is a nonconductive lever-actuated cam mechanism for loosening or tightening the clamp. The mechanism is set apart from the battery post connection and does not interfere with heat dissipation. Unique positive lever movement stops are also provided to affirmatively connote open and closed clamping positions while minimizing improper usage and breakage.

DESCRIPTION OF THE PREFERRED EMBODIMENTS

Figure 1:
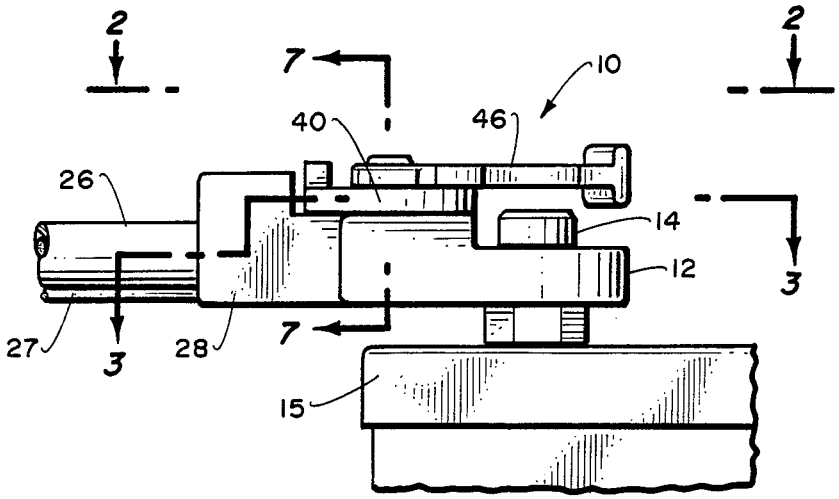
FIG. 1 is a side elevational view of the connector assembly of the invention applied to the post of a battery.
Figure 2:
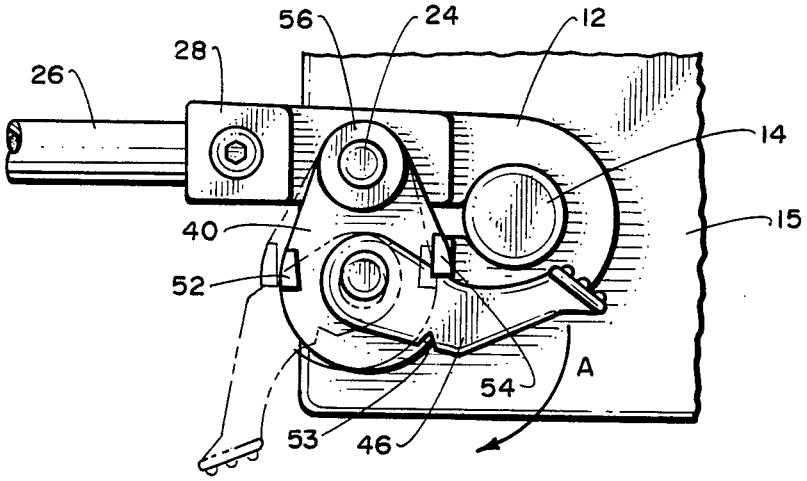
FIG. 2 is a top plan view taken along lines 2—2 of FIG. 1.
Figure 3:
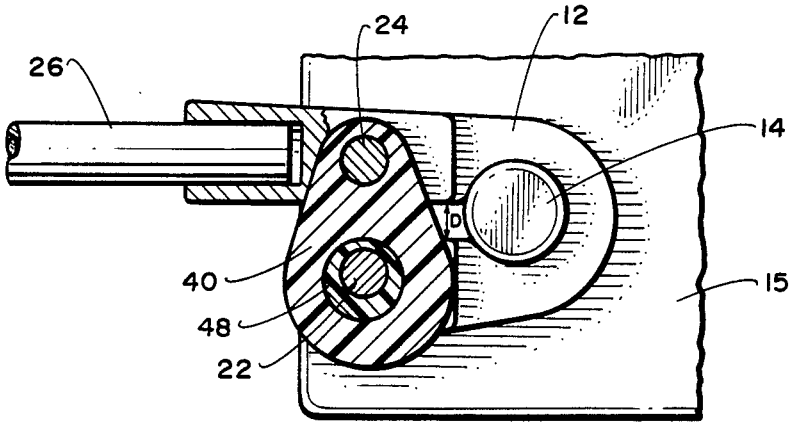
FIG. 3 is a cross-sectional view taken along lines 3—3 of FIG. 1.

With reference now to the drawings, the overall battery post connector of the invention is shown generally be reference numeral (10). The connector comprises an underlying electrical conductor clamp (12) which makes direct contact with a storage battery terminal depicted by reference numeral (14) extending from battery case (15). The clamp is generally U-shaped in structure and is preferably composed of a lead based composition similar to the composition of the battery terminal. In this way, electrolytic corrosion is eliminated.

The closed end of the clamp is provided with a round opening (16) for encompassing the battery terminal and forming the direct electrical contact. Extending outwardly from the opening are first and second legs (18) and (20). Each leg is provided with an integral upstanding post (22), (24), respectively.

Extending from the end of at least one of the legs is an attachment means for connection to an electrical conductor shown by reference numeral (26). Such means should also be adapted for connection with a grounding conductor (27). In the embodiment shown in FIGS. 1–9, the attachment means includes an extended leg portion (28) emanating from the end of leg (20). This portion is provided with a longitudinal opening (30) into which the conductors (26) and (27) may be inserted. To secure the conductors, a threaded transverse opening (32) is provided which interests opening (30) and includes a securement means for retaining the conductor therein. Such securement means is shown as set screw (34), however, other means such as pins, wedging, brazing, molding and the like would be suitable substitutes.

Figure 10:
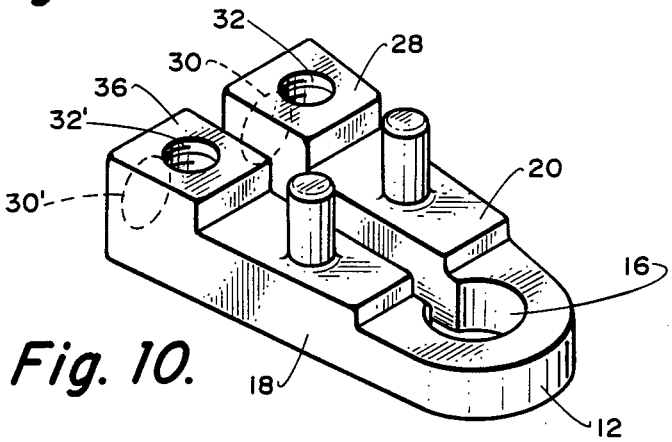
FIG. 10 is a top plan view of an alternative clamp which can be used with the invention.

The attachment means shown in FIG. 10 comprise extended portions (28), (36), from legs (20), (18), respectively. Such portions include corresponding longitudinal openings (30), (30') and transverse openings (32), (32') with securement means as above described.

Figure 11:
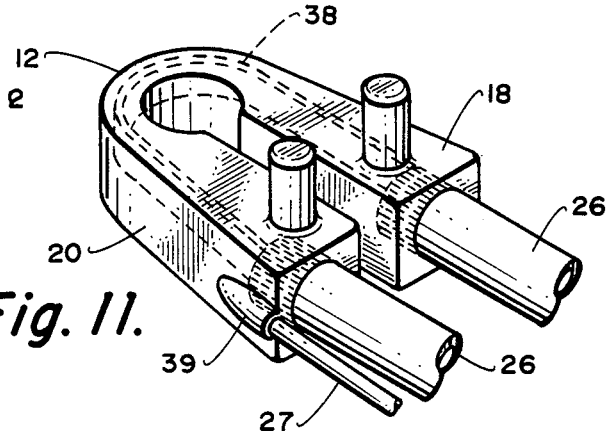
FIG. 11 is a top plan view of another alternative clamp with integral conductors that is suitable for use as part of the invention.

In the embodiment of FIG. 11, the attachment means does not include extended leg portions. Here, an alternative clamp is shown wherein conductors (26) and (27) are embedded within each respective leg of the clamp. This occurs by molding the clamp about the conductors. The ends of the conductors also include a continuous electrical conducting element (38) embedded within the clamp and connecting each end of conductor (26). The grounding conductor (27) is also molded into the side of the clamp at leg segment (39).

The distance "D" between each leg (18), (20) is varied by a lever and pivot member assembly which, in turn, varies the size of opening (16). The assembly includes pivot member (40) which is oblong in shape with its narrow end having a post opening (42) into which extends the leg upstanding post (24). The member is constructed of a nonconductive material such as plastic, reinforced polymers or resin materials, and is adapted to oscillate about the post (24). The larger end of the member is provided with a central opening (44) into which extends post (22).

Figure 4:
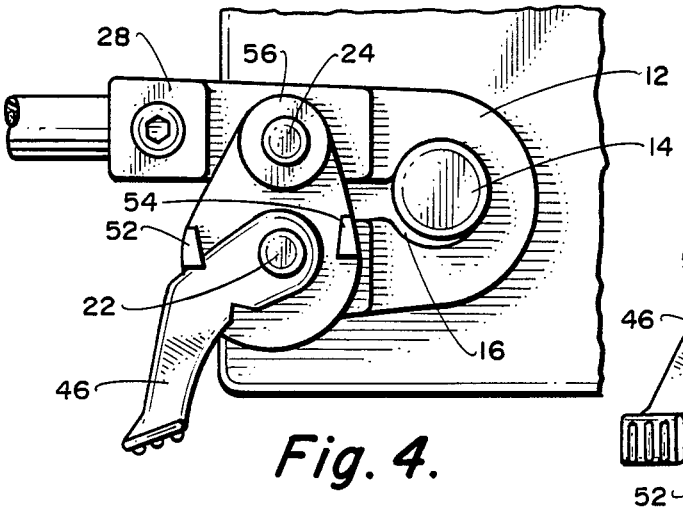
FIG. 4 is a top plan view similar to FIG. 2 with the assembly in an open position.
Figure 5:
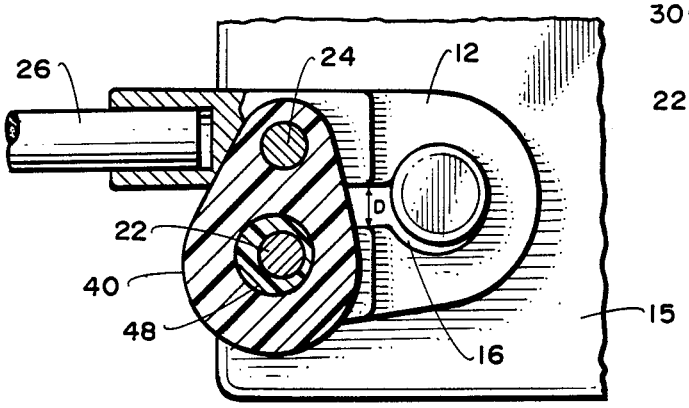
FIG. 5 is a cross-sectional view (as in FIG. 3) of the assembly shown in FIG. 4.
Figure 6:
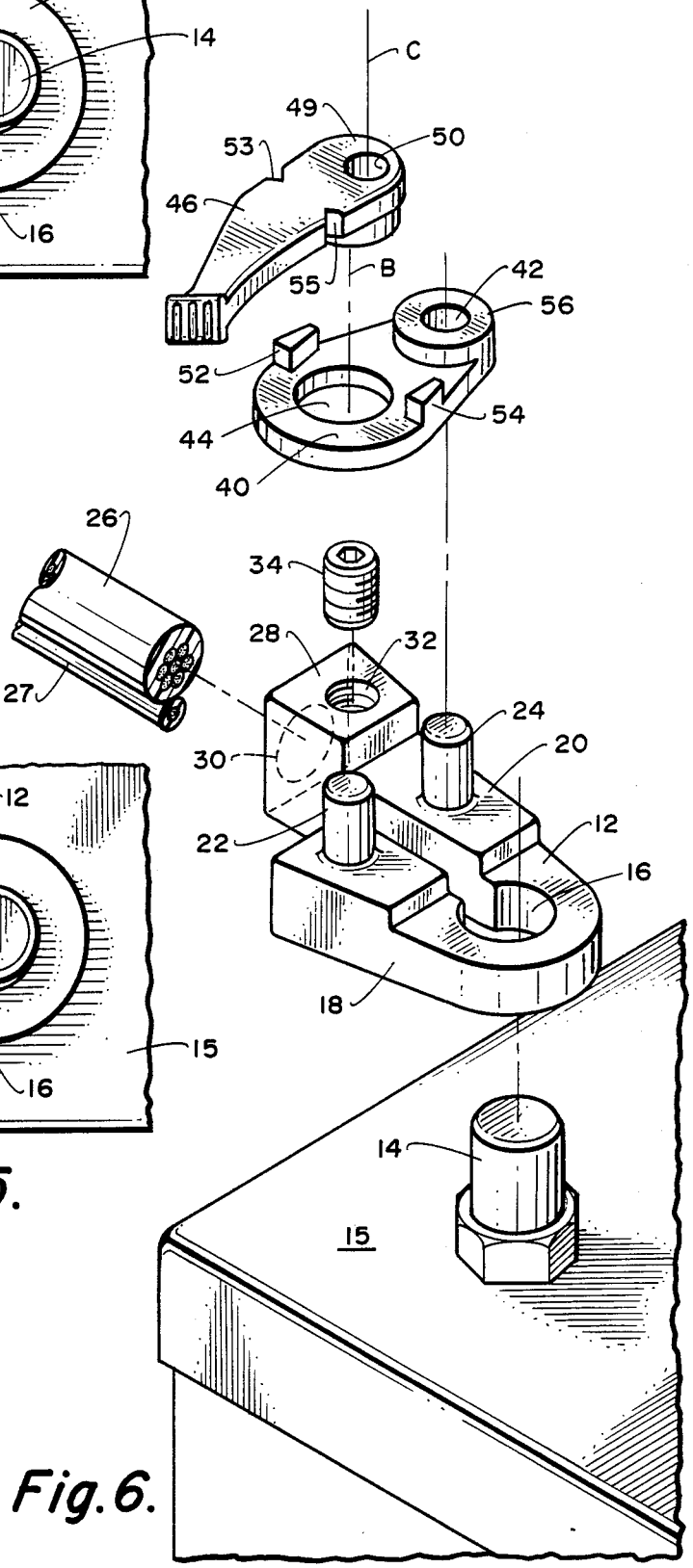
FIG. 6 is an exploded perspective view of the assembly shown in FIG. 1.
Figure 7:
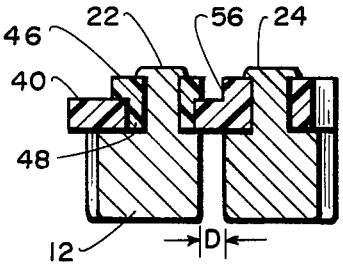
FIG. 7 is a cross-sectional view taken along lines 7—7 of FIG. 1.

Sized to fit within the central opening (44) is boss (48) extending normally from the proximal end (49) of lever (46). The rotational axis of the boss and central opening, shown by letter "B", are coextensive so that the lever will freely rotate therein. The boss includes aperture (50) through which extends post (22). The axis "C" of the aperture is offset from axis "B" of the central opening. As so arranged, when lever (46) is rotated in the direction of arrow "A" from its closed position shown in FIG. 2, to its open position shown in phantom, the axis "C" will move in an arc about the axis "B". This is best shown with reference to FIG. 3 where, with the lever in its closed position, the "C" axis is directly above the "B" axis corresponding to a minimum "D" spacing. When the lever is moved to an open position, as shown in FIGS. 4 and 5, the axis "C" is to the right of axis "B" corresponding to a maximum "D" spacing. Such movement will cause an oscillation of the pivot member (40) and a concomittant expansion and contraction of the round opening (16).

In the embodiments shown in FIGS. 1–7, the closed position of the lever setting the minimum distance between each leg and respective post axis is defined by abutment means shown as projection parts (52), (54). With the lever drawn against projection (54), the clamp legs are drawn together in a closed position. With the lever rotated in direction "A" against projection (52), the clamp will be in its open position allowing for removal of the clamp from the battery terminal. For convenience, lever notches (53),(55) are provided to accommodate the corresponding projection parts (52), (54).

Figure 8:
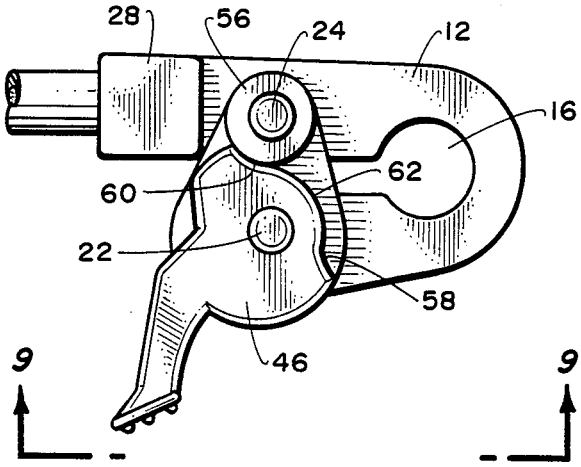
FIG. 8 is a top plan view of an alternative lever and pivot member for use as part of the clamping means of the invention showing an integral clamp conductor.
Figure 9:
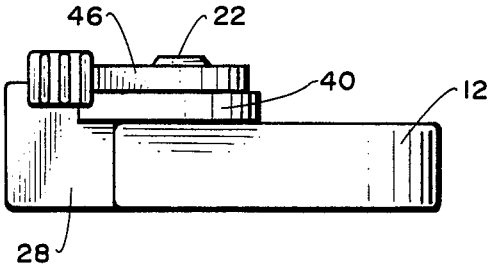
FIG. 9 is a side elevational view taken along lines 9—9 of FIG. 8.

FIG. 8 shows a pivot member and lever assembly wherein the projection parts (52), (54) are eliminated. In this case, the abutment means comprises an upraised portion (56) extending from the narrow end of the pivot member to form an annular area about aperture (42). The lever (46) with boss (48) extending downwardly from the proximal end (49) thereof extends into the central opening with aperture (50) over post (22) in the same manner as with the FIGS. 1–7 embodiment. With this improvement, the proximal end (49) is enlarged and includes two spaced-apart stop sections (58) and (60). These sections are indentations along the curved surface (62). The indentations are adapted to abut against the upraised portion (56) at predetermined arc limit positions corresponding to a maximum and minimum spacing of distance "D".

It will be appreciated that the pivot member and lever may be secured to either of the respective posts of the clamp. Securement may be accomplished by means well known in the art such as retainer clips, washers, pins, or simply by splaying the top end portion of each post. Also, it will be noted that either of the lever and pivot member assemblies disclosed will work equally well with the alternate clamp embodiments shown in FIGS. 10 and 11.

With the lever and pivot member assemblies offset from the clamp's connection to a battery post, greater cooling and elimination of corrosive thermal gases is possible. Further, the clamp composition proximates the battery post composition thereby maximizing conductivity and eliminating electrolytic corrosion created by dissimilar materials. Still further, the invention allows for a positive opening and closing of the clamp thereby avoiding the use of wrenches, threaded bolts and nuts with the possible overtightening thereof. The above advantages are especially apparent with electric vehicle applications wherein a large number of storage batteries must be recharged on a daily basis.

While the invention has been described with respect to preferred embodiments, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

We claim:

1. A battery post connector comprising:
   - a conductor clamp having spaced-apart first and second legs each having an upstanding post;
   - a pivot member rotatably connected to one of said posts having a central opening into which the other of said posts extends;
   - a lever having a boss extending therefrom for rotatable interfitting with the central opening, the rotational axis of said boss being coextensive with the axis of said central opening; and
   - an aperture through said boss having an axis offset from the boss rotational axis, said other of the posts extending into said aperture and about which the lever rotates.

2. The connector of claim 1 wherein said conductor clamp proximates a U-shape with a battery post opening at the closed end thereof.

3. The connector of claim 1 wherein the end of each leg has embedded therein an electrical conductor means.

4. The connector of claim 3 wherein said electrical conductor means includes a continuous element that extends along the longitudinal extent of said clamp from the end of each leg.

5. The connector of claim 1 wherein at least one of said legs includes means for attachment to an electrical conductor means.

6. The connector of claim 5 wherein said electrical conductor means includes an electrical grounding conductor.

7. The connector of claim 5 wherein said means for attachment comprises a longitudinal opening into the end of said one leg for insertion of the conductor means.

8. The connector of claim 7 wherein said means for attachment includes a transverse opening into the side of said one leg intersecting the longitudinal opening, said transverse opening including securement means to hold the conductor means in said longitudinal opening.

9. The connector of claim 1 wherein said boss extends normally from the proximal end of the lever.

10. The connector of claim 9 wherein said pivot member includes abutment means for limiting the rotational movement of said lever.

11. The connector of claim 10 wherein said abutment means comprises two projection parts positioned proximate opposing sides of said central opening.

12. The connector of claim 10 wherein said abutment means comprises an upraised portion about the central opening.

13. The connector of claim 12 wherein the proximal end of said lever includes spaced-apart stop sections for containing the upraised portion of said pivot member at predetermined arc limit positions of the lever.

14. The connector of claim 13 wherein said proximal end comprises an enlarged curved structure and said stop section comprises indentations in said structure.

* * * * *